US011671784B2

(12) United States Patent
Schissler

(10) Patent No.: US 11,671,784 B2
(45) Date of Patent: Jun. 6, 2023

(54) DETERMINATION OF MATERIAL ACOUSTIC PARAMETERS TO FACILITATE PRESENTATION OF AUDIO CONTENT

(71) Applicant: Meta Platforms Technologies, LLC, Menlo Park, CA (US)

(72) Inventor: Carl Schissler, Redmond, WA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 7 days.

(21) Appl. No.: 17/372,299

(22) Filed: Jul. 9, 2021

(65) Prior Publication Data

US 2021/0337342 A1 Oct. 28, 2021

Related U.S. Application Data

(63) Continuation of application No. 16/423,927, filed on May 28, 2019, now Pat. No. 11,102,603.

(51) Int. Cl.

| | |
|---|---|
| ***H04S 7/00*** | (2006.01) |
| ***H04R 5/033*** | (2006.01) |
| ***H04S 3/00*** | (2006.01) |
| ***H04R 5/04*** | (2006.01) |

(52) U.S. Cl.

CPC ..... *H04S 7/304* (2013.01); *H04R 5/033* (2013.01); *H04R 5/04* (2013.01); *H04S 3/008* (2013.01); *H04S 2400/01* (2013.01)

(58) Field of Classification Search

CPC ..... H04S 7/304; H04S 3/008; H04S 7/305; H04S 2400/01; H04R 5/033; H04R 5/04

See application file for complete search history.

(56) References Cited

U.S. PATENT DOCUMENTS

| | | | |
|---|---|---|---|
| 2004/0213415 | A1 | 10/2004 | Rama et al. |
| 2009/0154716 | A1 | 6/2009 | Jorgensen et al. |
| 2016/0277863 | A1 | 9/2016 | Cahill et al. |

OTHER PUBLICATIONS

Christensen C.L., et al., "Estimating Absorption of Materials to Match Room Model Against Existing Room Using a Genetic Algorithm," Forum Acusticum, European Acoustics Association, Sep. 2014, 10 pages.

Saksela K., et al., "Optimization of Absorption Placement using Geometrical Acoustic Models and Least Squares," The Journal of the Acoustical Society of America, Mar. 23, 2015, vol. 137, 8 pages.

(Continued)

*Primary Examiner* — Ping Lee

(74) *Attorney, Agent, or Firm* — Fenwick & West LLP

(57) ABSTRACT

Determination of material acoustic parameters for a headset is presented herein. A value of a material acoustic parameter is initialized. A simulation is performed using the value of the material acoustic parameter and a model. The model includes a three-dimensional representation of a local area occupied by the headset. During the simulation, the value of the material acoustic parameter is dynamically modified until a reverberation time calculated based on the modified value of the material acoustic parameter falls within a threshold value of a target reverberation time. The model is updated with the modified value of the material acoustic parameter. The model is used to determine one or more acoustic parameters. Audio content is rendered based on the one or more acoustic parameters so that the audio content appears originating from an object in the local area.

20 Claims, 7 Drawing Sheets

(56) References Cited

OTHER PUBLICATIONS

Schissler C., et al., "Acoustic Classification and Optimization for Multi-Modal Rendering of Real-World Scenes," 2017 IEEE transactions on visualization and computer graphics, Mar. 1, 2018, vol. 24 (3), pp. 1246-1259.

DETERMINATION OF MATERIAL ACOUSTIC PARAMETERS TO FACILITATE PRESENTATION OF AUDIO CONTENT

CROSS REFERENCE TO RELATED APPLICATIONS

This application is a continuation of co-pending U.S. application Ser. No. 16/423,927, filed May 28, 2019, which is incorporated by reference in its entirety.

BACKGROUND

The present disclosure relates generally to presentation of audio content, and specifically relates to determination of material acoustic parameters that facilitate presentation of audio content.

In an artificial reality environment, simulating sound propagation from an object to a listener may use knowledge about acoustic parameters of the room. To seamlessly place a virtual sound source in an environment, sound signals to each ear are determined based on sound propagation paths from the source, through an environment, to a listener (receiver). While models may be used to simulate sound propagation within an environment, it can be difficult to determine appropriate material properties for objects in the environment. Current techniques rely on tables of measured acoustic material data that are manually assigned by an administrator to objects in the room. However, assigning these properties is a time-consuming manual process that requires an in-depth user knowledge of acoustic materials. Also, the resulting simulation may not match known acoustic characteristics of the room due to differences between the manually assigned data and actual materials in the room.

SUMMARY

Embodiments of the present disclosure support a method, computer readable medium, and apparatus for determining material acoustic parameters to facilitate presentation of audio content (e.g., via an audio assembly on a headset). A material acoustic parameter (e.g., acoustic absorption coefficient, acoustic scattering coefficient, etc.) describes an acoustic property of a surface of an object. One or more material acoustic parameters may be used to determine acoustic parameters (e.g., room impulse response) that may be used (e.g., by the audio assembly) to present audio content.

In some embodiments, a value is initialized (e.g., by an audio server) for a material acoustic parameter describing a portion of a local area (e.g., a room). A simulation is performed using a model and the value of the material acoustic parameter. The simulation dynamically modifies the value of the material acoustic parameter until a simulated reverberation time calculated using the value of the material acoustic parameter is within a threshold value of a target reverberation time. The model is updated based on the modified value of the material acoustic parameter that causes the simulated reverberation time to be within the threshold value of the target reverberation time. The updated model is used to render audio content presented by a headset (e.g., via an audio system on the headset). For example, the updated model may be used to determine one or more acoustic parameters that are sent to the headset, and the headset may use the one or more acoustic parameters to present audio content.

Figure 1:
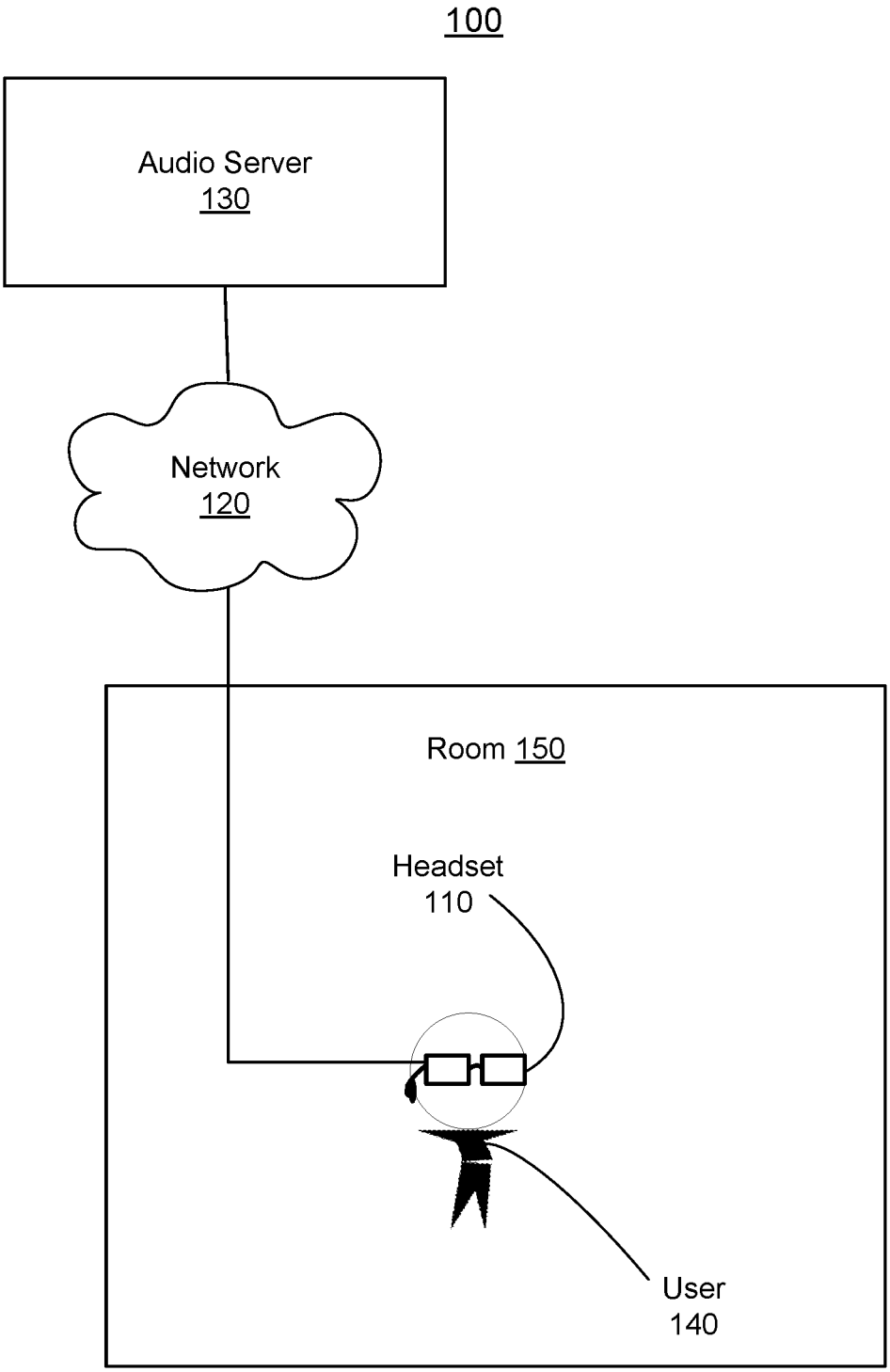
FIG. 1 is a block diagram of a system environment for a headset, in accordance with one or more embodiments.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

Embodiments of the present disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a headset, a head-mounted display (HMD) connected to a host computer system, a standalone HMD, a near-eye display (NED), a mobile device or computing system, or any other hardware platform capable of providing artificial reality content to one or more viewers.

An audio system for determination of material acoustic parameters to facilitate presentation of audio content is presented herein. The audio system includes an audio assembly communicatively coupled to an audio server. The audio assembly may be implemented on a headset. The headset may also include one or more imaging sensors. The audio assembly may request (e.g., over a network) one or more acoustic parameters from the audio server. The request may include, e.g., location information of the headset within a local area, visual information (depth information, color information, etc.) captured by the imaging sensors, audio data (e.g., reverberation time) measured by the microphone assembly, information describing the audio content (e.g., location information of the sound source of the audio content), etc.

The audio server determines material acoustic parameters for a local area occupied by the audio assembly. The audio server identifies and/or generates a model of the local area using the information in the request. The model is a 3-dimensional (3D) virtual representation of at least a portion of the local area and uses one or more material acoustic parameters to describe acoustic properties of surfaces within the local area. A material acoustic parameter may be, e.g., an acoustic absorption coefficient, an acoustic scattering coefficient, an acoustic transmission coefficient, an acoustic bidirectional scattering distribution function (BSDF), or some other parameter that describes acoustic properties of a surface.

The audio server initializes a value of each of one or more material acoustic parameters describing a portion of the local area. The audio server performs a simulation of reverberation time using the model and the value of each material acoustic parameter. The simulation dynamically modifies the value of each material acoustic parameter until a simulated reverberation time calculated using the value of the material acoustic parameter is within a threshold value of a target reverberation time. In some embodiments, the target reverberation time is determined based on one or more reverberation times measured by the audio assembly that are included in the request from the audio assembly. The audio server updates the model based on the modified value of each material acoustic parameter that causes the simulated reverberation time to be within the threshold value of the target reverberation time. In some embodiments, the audio server performs the simulation for each of a plurality of target reverberation times and updates the model with a modified value of each material acoustic parameter for each surface within the local area that causes the simulated reverberation time to be within the threshold value of the target reverberation time.

The audio server uses the updated model to determine one or more acoustic parameters. For example, the audio server uses the updated model, location information of the headset, and location information of the sound source of the audio content to determine sound propagation paths (e.g., direct path, early reflection, late reverberation etc.) in the local area. The audio server determines the acoustic parameters based on the sound propagation and transmits the acoustic parameters to the headset. The headset uses (e.g., via the audio assembly) the acoustic parameters to render audio content. In some embodiments, the audio content is spatialized audio content. Spatialized audio content is audio content that is presented in a manner such that it appears to originate from one or more points in an environment surrounding the user (e.g., from a virtual object in a local area of the user) and propagate toward the user.

FIG. 1 is a block diagram of a system environment 100 for a headset 110, in accordance with one or more embodiments. The system 100 includes the headset 110 that can be worn by a user 140 in a room 150. The headset 110 is connected to an audio server 130 via a network 120.

The network 120 connects the headset 110 to the audio server 130. The network 120 may include any combination of local area and/or wide area networks using both wireless and/or wired communication systems. For example, the network 120 may include the Internet, as well as mobile telephone networks. In one embodiment, the network 120 uses standard communications technologies and/or protocols. Hence, the network 120 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 120 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 120 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc. The network 120 may also connect multiple headsets located in the same or different rooms to the same audio server 130.

The headset 110 presents media to a user. In one embodiment, the headset 110 may be, e.g., a NED or a HMD. In general, the headset 110 may be worn on the face of a user such that content (e.g., media content) is presented using one or both lens of the headset. However, the headset 110 may also be used such that media content is presented to a user in a different manner. Examples of media content presented by the headset 110 include one or more images, video content, audio content, or some combination thereof. The headset 110 includes an audio assembly, and may also include at least one depth camera assembly (DCA) and/or at least one passive camera assembly (PCA). As described in detail below with regard to FIG. 4, a DCA generates depth image data that describes the 3D geometry for some or all of the local area (e.g., the room 150), and a PCA generates color image data for some or all of the local area. In some embodiments, the DCA and the PCA of the headset 110 are part of simultaneous localization and mapping (SLAM) sensors mounted on the headset 110 for determining visual information of the room 150. Thus, the depth image data captured by the at least one DCA and/or the color image data captured by the at least one PCA can be referred to as visual information determined by the SLAM sensors of the headset 110. Furthermore, the headset 110 may include position sensors or an inertial measurement unit (IMU) that tracks the position (e.g., location and pose) of the headset 110 within the local area. The headset 110 may also include a Global Positioning System (GPS) receiver to further track location of the headset 110 within the local area. The position (includes orientation) of the of the headset 110 within the local area is referred to as location information.

The audio assembly presents audio content to the user 140 of the headset 110. In some embodiments, the audio content is spatialized. To create spatialized audio content, it is beneficial to have accurate acoustic parameters for the local area. The audio assembly may measure audio data (e.g., reverberation time) in the local area (e.g., using a speaker assembly and a microphone assembly). The audio assembly generates an acoustic parameter query for sending to the audio server 130. An acoustic parameter query is a request for one or more acoustic parameters that the audio assembly can use to present audio content (e.g., spatialized audio content). The acoustic parameter query may include audio data measured by the audio assembly, visual information describing some or all of the local area, location information of the headset 110 within the local area, information of the audio content, or some combination thereof. Audio data includes, e.g., a reverberation time as measured/determined by the audio system from a particular position within the local area (i.e., the room 150). Visual information describes a 3D geometry of some or all of the local area and may also include color image data of some or all of the local area. Information of the audio content includes, e.g., information describing a location of a sound source of the audio content. The sound source of the audio content can be a real object in the local area or a virtual object. The headset 110 may communicate the acoustic parameter query via the network 120 to the audio server 130.

In some embodiments, the headset 110 obtains one or more acoustic parameters from the audio server 130. Acoustic parameters are parameters describing the local area of the headset that may be used by the audio assembly to render audio content. Acoustic parameters may include, e.g., a reverberation time from a sound source to the headset for each of a plurality of frequency bands, a reverberant level for each frequency band, a direct to reverberant ratio for each frequency band, a direction of a direct sound from the sound source to the headset for each frequency band, an amplitude of the direct sound for each frequency band, a propagation time for the direct sound from the sound source to the headset, relative linear and angular velocities between the sound source and headset, a time of early reflection of a sound from the sound source to the headset, an amplitude of early reflection for each frequency band, a direction of early reflection, room mode frequencies, room mode locations, or some combination thereof.

The headset 110 uses the acoustic parameters to present the audio content to the user 140. For example, the audio assembly may use the one or more acoustic parameters, head-related transfer functions (HRTFs), and convolution to render spatialized audio content to the user. In some embodiments, the rendered audio content is spatialized audio content. Additional details regarding operations and components of the headset 110 are discussed below in connection with FIG. 2B, FIG. 4, and FIG. 6.

The audio server 130 determines one or more acoustic parameters based on the acoustic parameter query received from the headset 110. The audio server 130 determines the one or more acoustic parameters using a model of the local area and information within the acoustic parameter query. The model is a 3-dimensional (3D) virtual representation of the local area. The model uses one or more material acoustic parameters to describe acoustic properties of surfaces within the virtual area. A material acoustic parameter may be, e.g., an acoustic absorption coefficient, an acoustic scattering coefficient, an acoustic transmission coefficient, an acoustic bidirectional scattering distribution function (BSDF), or some other parameter that describes acoustic properties of a surface. In some embodiments, the audio server 130 obtains the model using information from the acoustic parameter query. For example, the audio server 130 may update and/or generate the model based on the virtual information of the local area. As another example, the audio server 130 may retrieve the model from a databased based on the local information of the headset.

The audio server 130 initializes values for the one or more material acoustic parameters. For example, the audio server 130 may set a value of a material acoustic parameter some default value for all surfaces of the model, use machine learning to predict the value for some or all of the surfaces of the model based in part on the visual information and/or audio data (e.g., room impulse responses), or some combination thereof.

For a given material acoustic parameter, the audio server 130 performs a simulation (e.g., a ray tracing, finite-difference time-domain, or boundary element method simulation) using the model and the value of the material acoustic parameter. The simulation dynamically modifies the value of the material acoustic parameter until a simulated reverberation time calculated using the value of the material acoustic parameter is within a threshold value of a target reverberation time (e.g., as provided by the headset 110). The audio server 130 updates the model based on the modified value of the material acoustic parameter that causes the simulated reverberation time to be within the threshold value of the target reverberation time. The audio server 130 may perform the simulation for some or all of the one or more material acoustic parameters. The audio server 130 may perform the simulation for each of a plurality of target reverberation times. Additional details of the initialization and simulation are discussed below with regard to FIG. 2A.

The audio server 130 determines one or more acoustic parameters using the updated model. The one or more acoustic parameters can be a reverberation time from the sound source of the audio content to the headset 110 for each of a plurality of frequency bands, a reverberant level for each frequency band, a direct to reverberant ratio for each frequency band, a direction of a direct sound from the sound source to the headset for each frequency band, an amplitude of the direct sound for each frequency band, a propagation time for the direct sound from the sound source to the headset, relative linear and angular velocities between the sound source and headset, a time of early reflection of a sound from the sound source to the headset 110, an amplitude of early reflection for each frequency band, a direction of early reflection, room mode frequencies, and room mode locations. In some embodiments, the one or more acoustic parameters parametrize impulse responses from the sound source to the headset in the local area. In some cases, the one or more acoustic parameters may have previously been determined and stored, and the audio server 130 simply retrieves them based on the location information of the headset 110 in the acoustic parameter query. The audio server 130 provides the one or more acoustic parameters to the audio assembly on the headset 110.

In some embodiments, the audio server 130 also determines sound propagation paths of the audio content in the local area based on the updated model. The sound propagation paths may include direct paths, early reflections that correspond to first order acoustic reflections from nearby surfaces, and late reverberations that correspond to the first order acoustic reflections from farther surfaces or higher order acoustic reflections. The audio server 130 provides the sound propagation paths to the headset 110 for rendering the audio content. The audio server 130 may provide to the headset 110 one or more the acoustic parameters that are determined using the updated model.

Figure 2A:
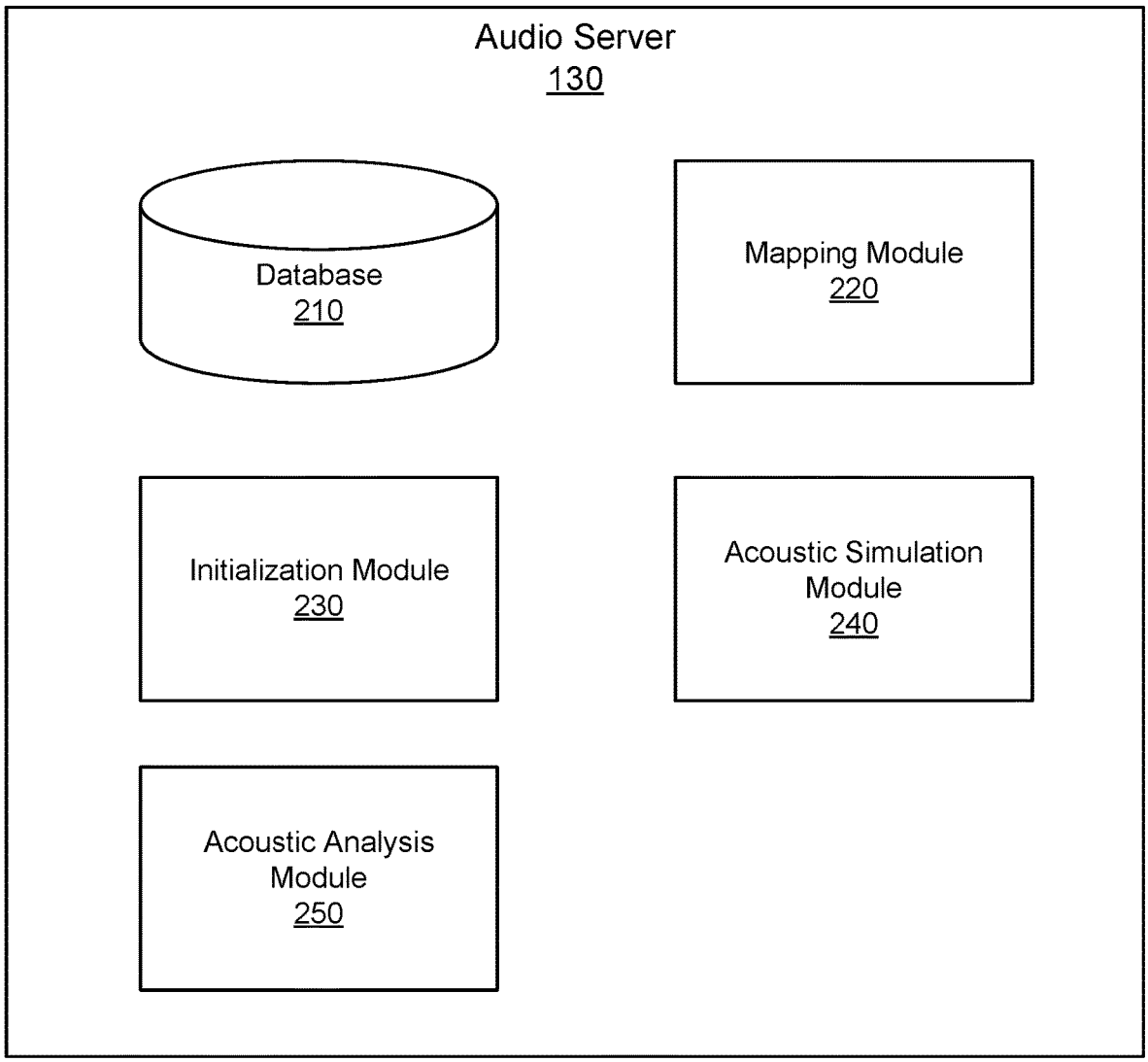
FIG. 2A is a block diagram of an audio server, in accordance with one or more embodiments.

FIG. 2A is a block diagram of the audio server 130, in accordance with one or more embodiments. The audio server 130 determines one or more acoustic parameters in response to an acoustic parameter query from an audio assembly. The audio server 130 includes a database 210, a mapping module 220, an initialization module 230, an acoustic simulation module 240, and an acoustic analysis module 250. In other embodiments, the audio server 130 can have any combination of the modules listed with any additional modules. In some other embodiments, the audio server 130 includes one or more modules that combine functions of the modules illustrated in FIG. 2A. One or more processors of the audio server 130 (not shown) may run some or all of the modules within the audio server 130.

The database 210 stores data for the audio server 130. The stored data may include, e.g., a virtual model, material acoustic parameters for various materials described by the virtual model, acoustic parameters for locations described by the virtual model, target reverberation times for locations in the virtual model, HRTFs for various users, audio data, visual information (depth information, color information, etc.), audio parameter queries, location information of a headset, some other information that may be used by the audio server 130, or some combination thereof. The virtual model describes one or more physical spaces and acoustic properties of those physical spaces. The acoustic properties include values of one or more material acoustic parameters determined by the acoustic simulation module 240 for those physical spaces. The acoustic properties can also include acoustic parameters of those spaces, which are determined based on the values of the material acoustic parameter of those spaces.

A particular location in the virtual model may correspond to a current physical location of the headset 110 within the room 150. Each location in the virtual model is associated with a set of acoustic parameters for a corresponding physical space that represents one configuration of the local area. The set of acoustic parameters of a location describes various acoustic properties of that one particular configuration of the local area. In some embodiments, the physical spaces whose acoustic properties are described in the virtual model include, but are not limited to, a conference room, a bathroom, a hallway, an office, a bedroom, a dining room, and a living room. Hence, the room 150 of FIG. 1 may be a conference room, a bathroom, a hallway, an office, a bedroom, a dining room, or a living room. In some embodiments, the physical spaces can be certain outside spaces (e.g., patio, garden, etc.) or combination of various inside and outside spaces. Acoustic parameters of the room 150 can be retrieved from the virtual model based on a location of the virtual model obtained from the mapping module 220.

The databased 210 can also store audio parameter queries from the headset 110. An audio parameter query is a request for acoustic parameters of a local area occupied by the headset 110 (such as the room 150 of FIG. 1) to render audio content. The acoustic parameter query includes information of the local area, the headset 110, and/or the audio content that the audio server 130 can use to determine the requested acoustic parameters. Information of the local area may include depth image data of the local area, color image data of the local area, or some combination thereof. Information of the headset 110 may include location information of the headset 110. Information of the audio content may include location information of a sound source of the audio content.

The mapping module 220 maps information in the audio parameter query to a location within the virtual model. The mapping module 220 determines the location within the virtual model corresponding to a current physical space where the headset 110 is located, i.e., a current configuration of the room 150. In some embodiments, the mapping module 220 searches the virtual model to identify a mapping between (i) the visual information that include at least e.g., information about geometry of surfaces of the physical space and information about acoustic materials of the surfaces or location information of the headset 110 and (ii) a corresponding configuration of a virtual space within the virtual model. In one embodiment, the mapping is performed by matching a geometry of the received visual information with a geometry of the virtual space within the virtual model. In another embodiment, the mapping is performed by matching location information of the headset 110 with a location within the virtual model. A match suggests that the virtual space in the model is a representation of the physical space. Note that in some instances, there may be multiple matches. In these cases, the mapping module 220 may select one of the matches. For example, the mapping module 220 uses GPS location data (e.g., from the headset 110) to select one of the matches.

If a match is found, the mapping module 220 retrieves the acoustic parameters that are associated with the virtual space from the virtual model and sent to the headset 110 for rendering the audio content.

If no match is found, this is an indication that a current configuration of the local area occupied by the headset 110 is not yet described by the virtual model. In such case, the mapping module 220 may develop a 3D virtual representation of the local area based on the visual information received from the headset 110 and update the virtual model with the 3D virtual representation. The 3D virtual representation of the local area that includes virtual representation of surfaces within the local area, such as walls, surfaces of furniture, surfaces of appliances, surfaces of other types of objects, and so on. The virtual model uses one or more material acoustic parameters to describe acoustic properties of the surfaces within the virtual area. In some embodiments, the mapping module 220 may develop a new model that includes the 3D virtual representation and uses one or more material acoustic parameters to describe acoustic properties of the surfaces within the virtual area. The new model can be saved in the database 210.

The mapping module may also inform at least one of the initialization module 230, the acoustic simulation module 240, and the acoustic analysis module 250 that no matching is found, so that the initialization module 230 and the acoustic simulation module 240 can determine the one or more material acoustic parameters and the acoustic analysis module 250 can use the one or more material acoustic parameters to determine acoustic parameters of the local area.

The initialization module 230 determines an initial value of each of one or more material acoustic parameters for the local area. In some embodiments, the initialization module 230 assigns a same value (e.g., 0.1) of a material acoustic parameter to the surfaces described in the model. In some other embodiments, the initialization module 230 assigns different initial values of a material acoustic parameter to different surfaces in the model. For example, the initialization module 230 classifies a material of each surface based on the visual information of the local area in the acoustic parameter query. The initialization module 230 determines an initial value of each material acoustic parameter for the surface based on the material classification.

In one embodiment, the initialization module 230 uses machine learning techniques for the material classification. The initialization module 230 can input the image data (or a part of the image data that is related to the surface) and/or audio data into a machine learning model, the machine learning model outputs a category of material. The machine learning model can be trained with different machine learning techniques, such as linear support vector machine (linear SVM), boosting for other algorithms (e.g., AdaBoost), neural networks, logistic regression, naïve Bayes, memory-based learning, random forests, bagged trees, decision trees, boosted trees, or boosted stumps. As part of the training of the machine learning model, a training set is formed. The training set includes image data and/or audio data of a group of surfaces and material categories of the surfaces in the group.

The acoustic simulation module 240 performs a simulation of acoustic properties of the local area using the virtual model and the value of each material acoustic parameter. The acoustic simulation module 240 receives one or more acoustic probes that describe frequency-dependent acoustic properties of a particular location (i.e., probe location) within the local area. An acoustic probe represents a target of the simulation for a particular location within the local area. An acoustic probe may be, e.g., a reverberation time measured from a particular location within the local area. The acoustic simulation module 240 dynamically modifies the one or more material acoustic parameters such that the simulated acoustic properties match the acoustic probes, e.g., the simulated acoustic properties fall within threshold values of the acoustic probes. In some embodiments, the acoustic simulation module 240 performs the simulation at each probe location. In the simulation, the sound source and listener are coincident at a particular probe location, and a direct sound propagation path is not computed. In some embodiments, the simulation is a ray-tracing based simulation. During the simulation, the acoustic simulation module 240 determines the number of rays that bounces off each of the surfaces within the 3D virtual representation of the local area and/or sound energy that bounces off the surfaces. The sound energy of each ray is based in part on the material acoustic parameters of materials the ray interacts with. Accordingly, as a simulated ray leaves a probe location propagates within the local area, and returns to the probe location via one or more reflections of surfaces within the local area, the material acoustic parameters associated with the surfaces can affect the sound ray. The acoustic simulation module 240 computes an impulse response of the local area at the probe location based on the simulated rays and the material acoustic parameters of surfaces within the local area. The acoustic simulation module 240 determines acoustic properties (e.g., reverberation time) based on the impulse response.

Note in some cases, there may be multiple probes within a particular local area. In these cases, data from each probe may have a weight (referred to as an influence weight) for each surface in the simulation, and the weights may be different from each other. A probe with a higher weight for a particular material means that the surface has a larger impact on the acoustic parameters at the probe location. Probes may be weighted according to how much impact each surface has on that the acoustic parameters at the probe location. In some embodiments, these weights may be determined by calculating the total sound energy emitted from the sound source at the probe location that reflects from each surface in the local area. The weights may also be determined by the age of the probe, the confidence of the acoustic parameters at the probe location, or any combination thereof.

In some embodiments, the acoustic probes represent target reverberation times, e.g., reverberation times measured by the headset 110. During the simulation, the acoustic simulation module 240 dynamically modifies the value of the material acoustic parameter until a reverberation time calculated using the value of the material acoustic parameter (e.g., RT60 referred hereinafter as $RT60_S$) is within a threshold value of a target reverberation time (e.g., RT60, referred hereinafter as $RT60_T$). The threshold value may be 95% or 105% of $RT60_T$. The simulation may be frequency dependent. In some embodiments, the acoustic simulation module 240 may perform a simulation for a number of frequency bands or perform a simulation for an individual frequency band.

In some embodiments, the acoustic simulation module 240 uses the Sabine reverberation time equation in the following to perform the simulation.

$$RT60=0.161*V/(a*S) \tag{1}$$

where RT60 is reverberation time, V is local area volume, a is a material acoustic parameter, such as material absorption coefficient, and S is surface area. Based on the Sabine reverberation time equation, the acoustic simulation module 240 can derive a relationship between the ratio of $RT60_S$) to $RT60_T$ (referred hereinafter as D) and the ratio of a value of the material acoustic parameter corresponding to the simulated reverberation time (referred hereinafter as $a_S$) and a value of the material acoustic parameter corresponding to the target reverberation time (referred hereinafter as $a_T$). The relationship is represented by Equation (2) in the following:

$$RT60_T/RT60_S=a_S/a_T \tag{2}$$

The acoustic simulation module 240 further obtains Equation (3) to calculate $a_T$:

$$a_T = a_S * \left(\frac{RT60_S}{RT60_T}\right) = a_S * D \tag{3}$$

The acoustic simulation module 240 can use Equation (3) to run a plurality of iterations. In each iteration, the acoustic simulation module 240 obtains a different value of the material acoustic parameter from the previous iteration. For instance, the acoustic simulation module 240 obtains $a_n$ for iteration n, and obtains $a_{n+1}$ for the next iteration, iteration n+1. In one embodiment, the acoustic simulation module 240 determines $a_{n+1}$ based on $a_n$ by using the Equation (4):

$$a_{n+1}=a_n*D \tag{4}$$

In another embodiment, the acoustic simulation module 240 modifies the value of the material acoustic material in each iteration by a pre-determined increment. In yet another embodiment, the change in the value of the material acoustic material in an iteration decreases with D. For example, after D falls in the range from 0.9 to 1.1, the acoustic simulation module 240 slows down the modification, meaning the acoustic simulation module 240 makes a smaller change in a in each later iteration.

In some embodiments, the acoustic simulation module 240 performs the simulation for each surface in the model. For example, for surface m, the acoustic simulation module 240 obtains a value of the material acoustic parameter $a_{m,n}$ in iteration n and determines $a_{m,n+1}$ in the next iteration based on $a_{m,n}$ using Equation (5):

$$a_{m,n+1}=a_{m,n}*D_m \tag{5}$$

where $D_m=RT60_{S,m}/RT60_{T,m}$.

In some embodiments, the acoustic simulation module 240 determines $RT60_T$ based on one or more reverberation times in the acoustic parameter query. The reverberation times can be measured by the audio assembly or multiple audio assemblies at different positions in the local area. The acoustic simulation module 240 determines an influence weight (w) of each measured reverberation time (referred hereinafter as $RT60_P$) may have. The acoustic simulation module 240 determines $RT60_T$ as a weighted average of $RT60_P$ based on Equation (6).

$$RT60_T = \mathrm{SUM}(RT60_p * w_p)/\mathrm{SUM}(w_p) \quad (6)$$

For each surface, the acoustic simulation module 240 may determine a weight average ratio $D_{m,avg}$ based on Equation (7).

$$D_{m,avg} = \mathrm{SUM}(D_p * w_{mp})/\mathrm{SUM}(w_{mp}) \quad (7)$$

where $D_{m,avg}$ is the weight average D for surface m, $D_p$ is the D for a measured reverberation time p, $w_{m,p}$ is the influence weight of the measured reverberation time for the surface.

The acoustic simulation module 240 may determine an importance weight (W) for each measured reverberation time. A measured reverberation time with a higher weight has more control over the simulation. The acoustic simulation module 240 determines $RT60_T$ based on Equation (8) and determines $D_{m,avg}$ based on Equation (9).

$$RT60_T = \mathrm{SUM}(RT60_p * w_p * W_p)/\mathrm{SUM}(w_p * W_p) \quad (8)$$

$$D_{m,avg} = \mathrm{SUM}(D_p * W_{mp} * W_p)/\mathrm{SUM}(w_{mp} * W_p) \quad (9)$$

where $W_p$ is the importance weight of the measured reverberation time p for the surface m.

The acoustic simulation module 240 may un-do an iteration n, in response to $D_n$ being significantly different from another ratio $RT60_{S,n+1}/RT60_{S,n}$. For example, the acoustic simulation module 240 may undo iteration n, in response to a determination that a difference between $D_n$ and $RT60_{S,n+1}/RT60_{S,n}$ exceeds a threshold value. To undo the iteration, the acoustic simulation module 240 replaces $D_n$ with a value determined based on $D_{n-1}$. In one embodiment, the value equals $(1-b)*D_{n-1}+b*D_n$, where b is a value between 0 and 1. The value of b indicates effectiveness of iteration n, i.e., how close $D_n$ is to $RT60_{S,n+1}/RT60_{S,n}$.

In some embodiments, the acoustic simulation module 240 stops the simulation after $RT60_S$ falls within a threshold value of $RT60_T$. For example, the acoustic simulation module 240 monitors D and stops the simulation after D falls in a threshold range, such as a range from 0.95 to 1.05. In some embodiments, the acoustic simulation module 240 stops the simulation after D is equal to (or substantively close to) 1, meaning $RT60_S$ matches $RT60_T$. In some embodiments, the acoustic simulation module 240 stops the simulation after a threshold number of iterations are done, such as 20 iterations, or a maximum computation time has been exceeded, even though $RT60_S$ has not fallen within the threshold value of $RT60_T$. Data generated during the simulation can be stored at the database 210.

The acoustic simulation module 240 uses the value of the material acoustic parameter that causes $RT60_S$ to fall within a threshold value of $RT60_T$ to update the model. In embodiments where the acoustic simulation module 240 stops the simulation before $RT60_S$ falls within a threshold value of $RT60_T$, the acoustic simulation module 240 may use the value of the material acoustic parameter obtained from the last iteration to update the model. The updated model can be stored in the database 210.

The acoustic analysis module 250 uses the updated model to determine one or more acoustic parameters. In some embodiments, the acoustic analysis module 250 determines the one or more acoustic parameters based on information in the acoustic parameter query, such as the location information of the headset 110 and the location information of the sound source of the audio content. The location information of the headset 110 indicates a location of a listener in the model. The location information of the sound source of the audio content indicates a location of the sound source in the model. The sound source can be a real object in the local area or a virtual sound source. The acoustic analysis module 250 can update the virtual model stored in the database 210 with the one or more acoustic parameters of the local area.

The acoustic analysis module 250 may also use the updated model and information in the acoustic parameter query to determine sound propagation paths from the sound source to the listener (e.g., the headset 110). The sound propagation paths may include, e.g., direct sound path, early reflections, or late reverberations. The acoustic analysis module 250 transmits the acoustic parameters and/or sound propagation paths to the headset 110, such as the audio assembly implemented on the headset 110, for rendering the audio content.

Figure 2B:
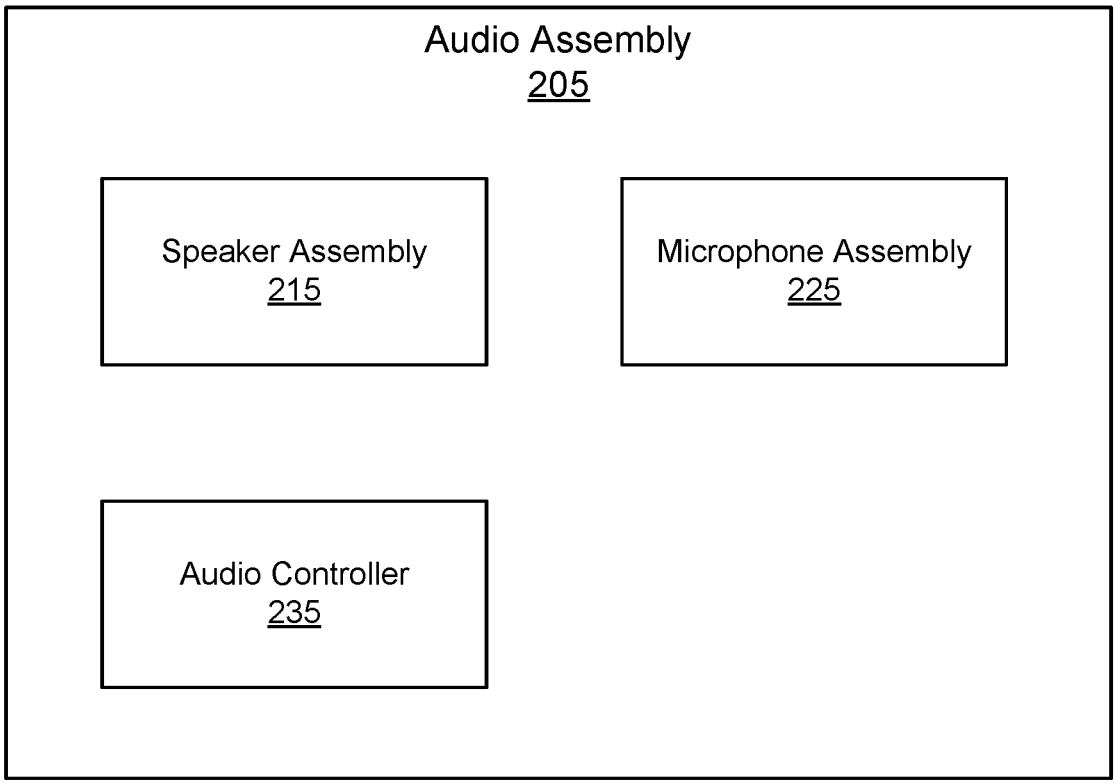
FIG. 2B is a block diagram of an audio assembly, in accordance with one or more embodiments.

FIG. 2B is a block diagram of an audio assembly 205, in accordance with one or more embodiments. Some or all of the audio assembly 205 may be part of a headset (e.g., the headset 110). The audio assembly 205 includes a speaker assembly 215, a microphone assembly 225, and an audio controller 235. In one embodiment, the audio assembly 205 further comprises an input interface (not shown in FIG. 2B) for, e.g., controlling operations of different components of the audio assembly 205. In other embodiments, the audio assembly 205 can have any combination of the components listed with any additional components.

The speaker assembly 215 produces sound for user's ears, e.g., based on audio instructions from the audio controller 235. For example, the speaker assembly 215 produces sound to facilitate measurement of reverberation times in the local area occupied by the headset 110 based on audio instructions from the audio controller 235. In some embodiments, the speaker assembly 215 is implemented as pair of air conduction transducers (e.g., one for each ear) that produce sound by generating an airborne acoustic pressure wave in the user's ears, e.g., in accordance with the audio instructions from the audio controller 235. Each air conduction transducer of the speaker assembly 215 may include one or more transducers to cover different parts of a frequency range. For example, a piezoelectric transducer may be used to cover a first part of a frequency range and a moving coil transducer may be used to cover a second part of a frequency range. In some other embodiments, each transducer of the speaker assembly 215 is implemented as a bone conduction transducer that produces sound by vibrating a corresponding bone in the user's head. Each transducer implemented as a bone conduction transducer may be placed behind an auricle coupled to a portion of the user's bone to vibrate the portion of the user's bone that generates a tissue-borne acoustic pressure wave propagating toward the user's cochlea, thereby bypassing the eardrum. In some other embodiments, each transducer of the speaker assembly 215 is implemented as a cartilage conduction transducer that produces sound by vibrating one or more portions of the auricular cartilage around the outer ear (e.g., the pinna, the tragus, some other portion of the auricular cartilage, or some combination thereof). The cartilage conduction transducer generates airborne acoustic pressure waves by vibrating the one or more portions of the auricular cartilage.

The microphone assembly 225 detects sound from the local area. In some embodiments, the microphone assembly 225 transmits data of the detected sound to the audio controller 235 to measure reverberation times in the local area. The microphone assembly 225 may include a plurality of acoustic sensors. The plurality of acoustic sensors may include, e.g., at least one acoustic sensor configured to measure sound at an entrance of an ear canal for each ear, one or more acoustic sensors positioned to capture sound from the local area, one or more acoustic sensors positioned to capture sound from the user (e.g., user speech), or some combination thereof.

The audio controller 235 provides audio instructions to the speaker assembly 215 for generating sound by generating audio content. The audio controller 235 presents the audio content to appear originating from an object (e.g., virtual object or real object) within a local area of the headset 110, which is known as spatialized audio content. In some embodiments, the audio controller 235 renders a source audio signal using one or more acoustic parameters. For example, the audio controller 235 determines impulse responses of the audio signal in the local area based on the acoustic parameters. The audio controller 235 uses the impulse responses and sound propagation paths of the audio signal in the local area to render the audio content. The sound propagation paths include direct sound paths, early reflections, and late reverberations. The sound propagation paths may be received from the audio server 130 or determined by the audio controller 235. The audio controller 235 may use different algorithms to render different sound propagation paths. In one embodiment, the audio controller 235 uses interpolated delay lines to apply propagation delay to direct sound and early reflections. Direct sound, early reflections, and late reverberation may be spatially rendered as an ambisonic signal and/or by convolving the audio signal with head-related transfer functions (HRTF) corresponding to the sound path arrival directions at the headset location. Late reverberation may be rendered by convolving the source's audio signal with an impulse response, or by means of artificial reverberation algorithms. The rendering may involve frequency-dependent filtering that applies the effect of acoustic materials, air absorption, diffraction, etc. on the simulation frequency bands.

In an embodiment, the acoustic parameters are received from the audio server 130 in response to a query from the audio assembly 205. The query may include, e.g., virtual information of the local area, location information of the headset, audio data (e.g., reverberation time) measured by the audio assembly, and location information of a sound source. In another embodiment, the audio controller 235 receives material acoustic parameters of surfaces within the local area in response to the query and determines the acoustic parameters for the current configuration of the local area based on the material acoustic parameters and other information, e.g., visual information of the local area determined by one or more of the SLAM sensors mounted on the headset 110, sound in the local area monitored by the microphone assembly 225, information about a position of the headset 110 in the local area determined by the position sensor 440, information about position of a sound source in the local area, etc. In yet another embodiment, the audio controller 235 obtains the acoustic parameters from a computer-readable data storage (i.e., memory) coupled to the audio controller 235 (not shown in FIG. 2B). The memory may store different acoustic parameters (reverberation times, values of material acoustic parameters) for a limited number of configurations of physical spaces.

The audio controller 235 may obtain information describing at least a portion of the local area, e.g., from one or more cameras of the headset 110. The information may include depth image data, color image data, location information of the local area, or combination thereof. The depth image data may include geometry information about a shape of the local area defined by surfaces of the local area, such as surfaces of the walls, floor and ceiling of the local area. The color image data may include information about acoustic materials associated with surfaces of the local area. The location information may include GPS coordinates or some other positional information of the local area.

Figure 3:
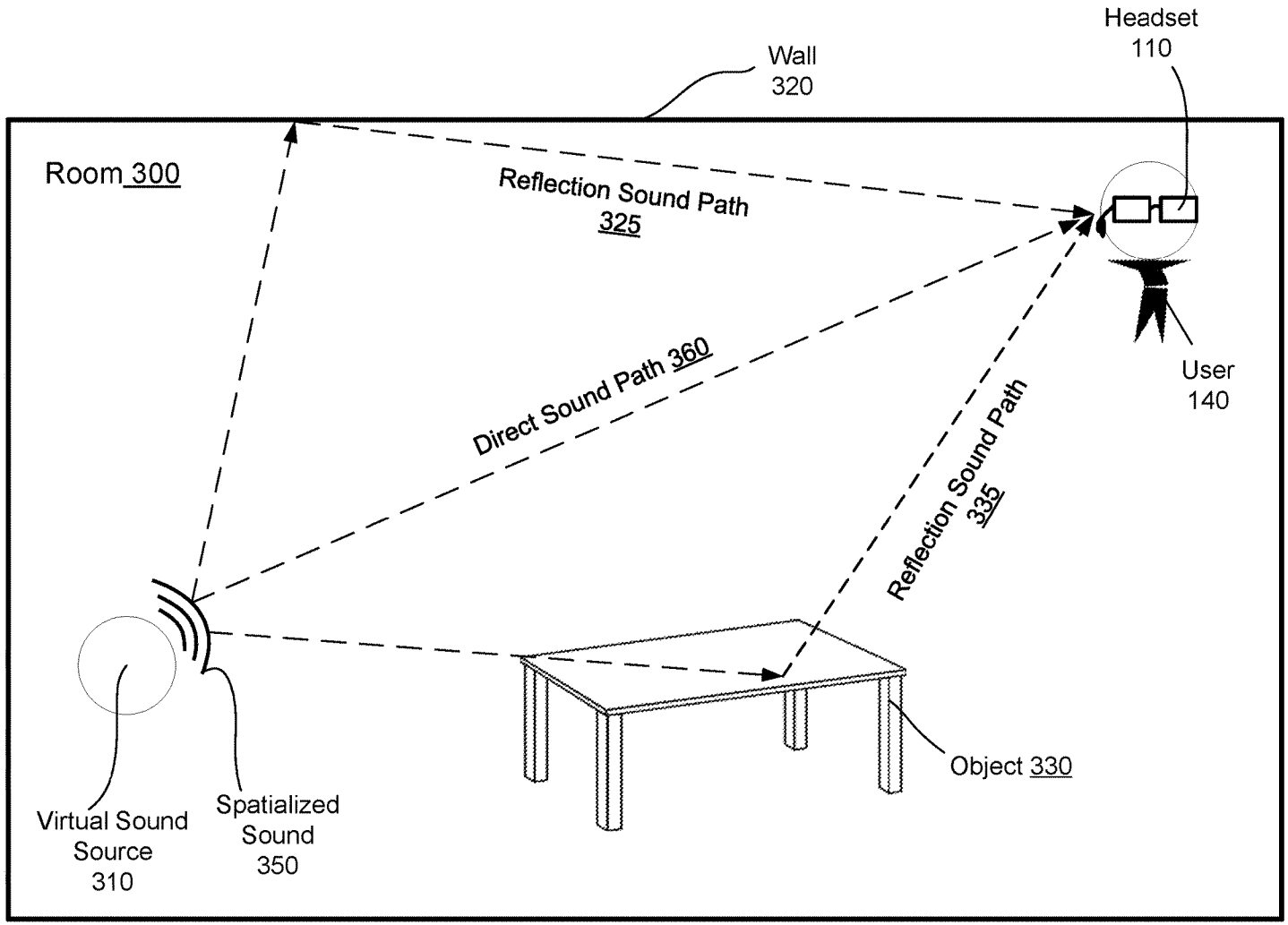
FIG. 3 illustrates sound propagation paths of a spatialized sound from a virtual sound source to a user of a headset, in accordance with one or more embodiments.

FIG. 3 illustrates sound propagation paths of a spatialized sound 350 from a virtual sound source 310 to a user 140 of a headset 110, in accordance with one or more embodiments. The user 140 is wearing the headset 110 is located in the room 300. The headset 110 presents the spatialized sound 350 and renders the spatialized sound 350 so that it appears to the user 140 originating from the virtual sound source 310. In some embodiments, the sound propagation paths are determined by the audio server 130 and provided to an audio assembly implemented on the headset 110 for generating the spatialized sound 350.

The sound propagation paths in FIG. 3 include a direct sound path 360, a reflection sound path 325, and another reflection sound path 335. The direct sound path 360 is a path from the virtual sound source 310 to the (e.g., right) ear of the user 140 without reflection. The reflection sound path 335 is a path from the virtual sound source 310 to the (e.g., right) ear of the user 140 with reflection by the object 330. The reflection by the object 330 is an early reflection, i.e., reflection corresponding to the first order acoustic reflections from nearby surfaces. The reflection sound path 325 is a path from the virtual sound source 310 to the (e.g., right) ear of the user 140 with reflection by the wall 320. The reflection by the object 320 is late reverberation that corresponds to the first order acoustic reflections from farther surfaces or higher order acoustic reflections.

The sound propagation paths 360, 325, and 335 are rendered differently. In one embodiment, propagation delay is applied to the direct sound path 325 and the reflection sound path 335 by using interpolated delay lines. The sound propagation paths 360, 325, and 335 may be spatially rendered as an ambisonic signal and/or by convolving the audio signal with head-related transfer functions (HRTF) corresponding to the sound path arrival directions at the location of the headset 110. The reflection sound path 325 may be rendered by convolving the audio signal with an impulse response, or by means of artificial reverberation algorithms. The rendering may involve frequency-dependent filtering that applies the effect of acoustic materials, air absorption, diffraction, etc. on the simulation frequency bands.

Figure 4:
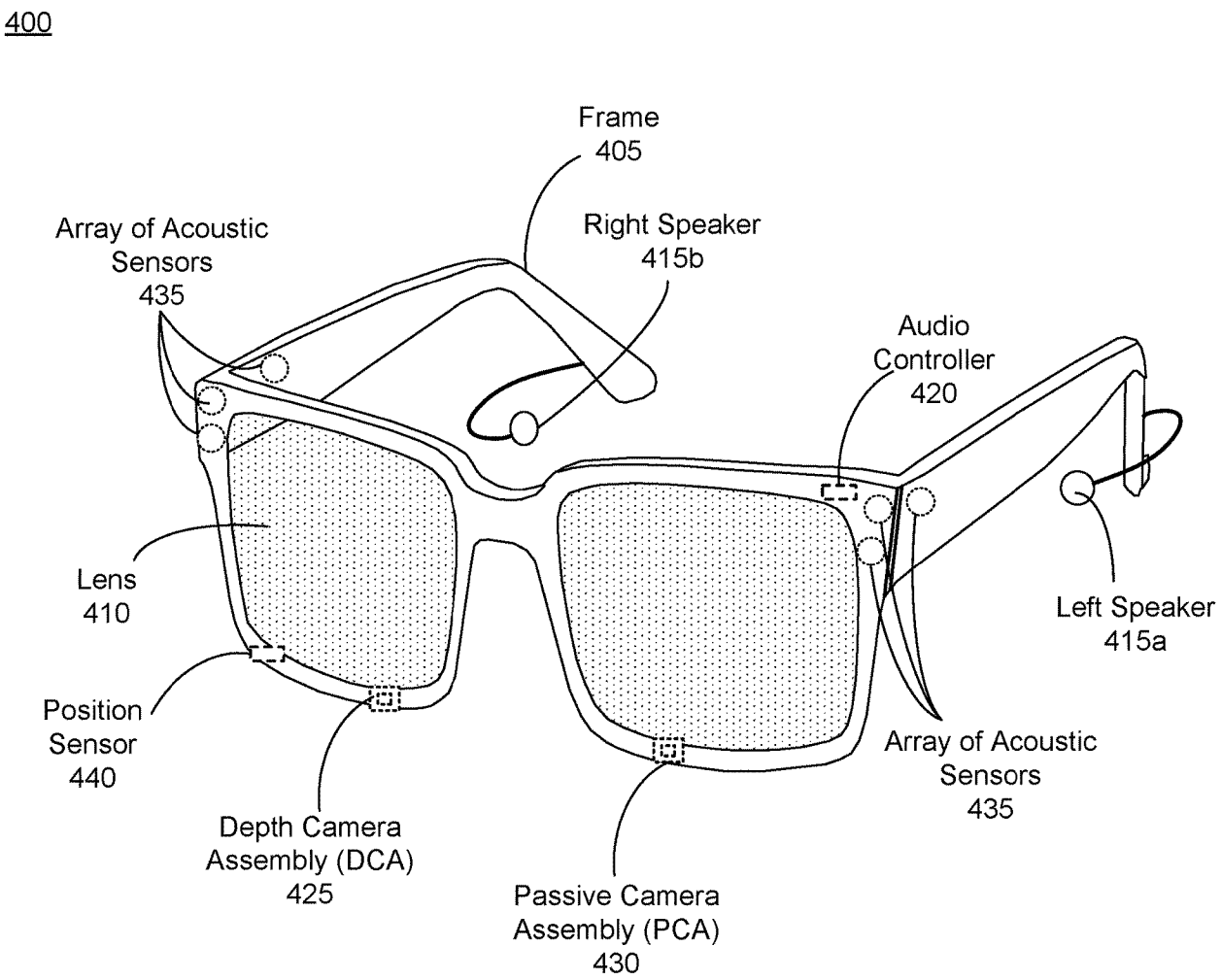
FIG. 4 is a perspective view of a headset including an audio assembly, in accordance with one or more embodiments.

FIG. 4 is a perspective view of a headset 400 including an audio assembly, in accordance with one or more embodiments. The headset 110 may be an embodiment of the headset 400. In some embodiments (as shown in FIG. 4), the headset 400 is implemented as a NED. In alternate embodiments (not shown in FIG. 4), the headset 400 is implemented as an HMD. In general, the headset 400 may be worn on the face of a user such that content (e.g., media content) is presented using one or both lenses 410 of the headset 400. However, the headset 400 may also be used such that media content is presented to a user in a different manner. Examples of media content presented by the headset 400 include one or more images, video, audio, or some combination thereof. The headset 400 may include, among other components, a frame 405, a lens 410, a DCA 425, a PCA 430, a position sensor 440, and an audio assembly. The audio assembly of the headset 400 includes, e.g., speakers 415*a* and 415*b*, an array of acoustic sensors 435, an audio controller 420, one or more other components, or combination thereof. The audio assembly of the headset 400 is an embodiment of the audio assembly 205 described above in conjunction with FIG. 2B. The DCA 425 and the PCA 430 may be part of SLAM sensors mounted the headset 400 for capturing visual information of a local area surrounding some or all of the headset 400. While FIG. 4 illustrates the components of the headset 400 in example locations on the headset 400, the components may be located elsewhere on the headset 400, on a peripheral device paired with the headset 400, or some combination thereof.

The headset 400 may correct or enhance the vision of a user, protect the eye of a user, or provide images to a user. The headset 400 may be eyeglasses which correct for defects in a user's eyesight. The headset 400 may be sunglasses which protect a user's eye from the sun. The headset 400 may be safety glasses which protect a user's eye from impact. The headset 400 may be a night vision device or infrared goggles to enhance a user's vision at night. The headset 400 may be a near-eye display that produces artificial reality content for the user. Alternatively, the headset 400 may not include a lens 410 and may be a frame 405 with an audio assembly that provides audio content (e.g., music, radio, podcasts) to a user.

The frame 405 holds the other components of the headset 400. The frame 405 includes a front part that holds the lens 410 and end pieces to attach to a head of the user. The front part of the frame 405 bridges the top of a nose of the user. The end pieces (e.g., temples) are portions of the frame 405 to which the temples of a user are attached. The length of the end piece may be adjustable (e.g., adjustable temple length) to fit different users. The end piece may also include a portion that curls behind the ear of the user (e.g., temple tip, ear piece).

The lens 410 provides or transmits light to a user wearing the headset 400. The lens 410 may be prescription lens (e.g., single vision, bifocal and trifocal, or progressive) to help correct for defects in a user's eyesight. The prescription lens transmits ambient light to the user wearing the headset 400. The transmitted ambient light may be altered by the prescription lens to correct for defects in the user's eyesight. The lens 410 may be a polarized lens or a tinted lens to protect the user's eyes from the sun. The lens 410 may be one or more waveguides as part of a waveguide display in which image light is coupled through an end or edge of the waveguide to the eye of the user. The lens 410 may include an electronic display for providing image light and may also include an optics block for magnifying image light from the electronic display.

The DCA 425 captures depth image data describing depth information for a local area surrounding the headset 110, such as a room. In some embodiments, the DCA 425 may include a light projector (e.g., structured light and/or flash illumination for time-of-flight), an imaging device, and a controller (not shown in FIG. 4). The captured data may be images captured by the imaging device of light projected onto the local area by the light projector. In one embodiment, the DCA 425 may include a controller and two or more cameras that are oriented to capture portions of the local area in stereo. The captured data may be images captured by the two or more cameras of the local area in stereo. The controller of the DCA 425 computes the depth information of the local area using the captured data and depth determination techniques (e.g., structured light, time-of-flight, stereo imaging, etc.). Based on the depth information, the controller of the DCA 425 determines absolute positional information of the headset 110 within the local area. The DCA 425 may be integrated with the headset 110 or may be positioned within the local area external to the headset 110. In some embodiments, the controller of the DCA 425 may transmit the depth image data to the audio controller 420 of the headset 110, e.g. for further processing and communication to the audio server 130.

The PCA 430 includes one or more passive cameras that generate color (e.g., RGB) image data. Unlike the DCA 425 that uses active light emission and reflection, the PCA 430 captures light from the environment of a local area to generate color image data. Rather than pixel values defining depth or distance from the imaging device, pixel values of the color image data may define visible colors of objects captured in the image data. In some embodiments, the PCA 430 includes a controller that generates the color image data based on light captured by the passive imaging device. The PCA 430 may provide the color image data to the audio controller 420, e.g., for further processing and communication to the audio server 130.

In some embodiments, the DCA 425 and PCA 430 are the same camera assembly, such as a color camera system that uses stereo imaging for generating depth information.

The position sensor 440 generates location information of the headset 400 based on one or more measurement signals in response to motion of the headset 4010. The position sensor 440 may be located on a portion of the frame 405 of the headset 400. The position sensor 440 may include a position sensor, an inertial measurement unit (IMU), or both. Some embodiments of the headset 400 may or may not include the position sensor 440 or may include more than one position sensors 440. In embodiments in which the position sensor 440 includes an IMU, the IMU generates IMU data based on measurement signals from the position sensor 440. Examples of position sensor 440 include: one or more accelerometers, one or more gyroscopes, one or more magnetometers, another suitable type of sensor that detects motion, a type of sensor used for error correction of the IMU, or some combination thereof. The position sensor 440 may be located external to the IMU, internal to the IMU, or some combination thereof.

Based on the one or more measurement signals, the position sensor 440 estimates a current position of the headset 400 relative to an initial position of the headset 400. The estimated position may include a location of the headset 400 and/or an orientation of the headset 400 or the user's head wearing the headset 400, or some combination thereof. The orientation may correspond to a position of each ear relative to a reference point. In some embodiments, the position sensor 440 uses the depth information and/or the absolute positional information from the DCA 425 to estimate the current position of the headset 400. The position sensor 440 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 400 from the sampled data. For example, the IMU integrates the measurement signals received from the accelerometers over time to estimate a velocity vector and integrates the velocity vector over time to determine an estimated position of a reference point on the headset 400. The reference point is a point that may be used to describe the position of the headset 400. While the reference point may generally be defined as a point in space, however, in practice the reference point is defined as a point within the headset 400.

The audio assembly generates spatialized audio content based on acoustic parameters that describe acoustic properties of a local area occupied by the headset 400. In some embodiments, the audio assembly sends a query to an audio server (e.g., the audio server 130) for acoustic parameters.

The query may include virtual information of the local area, location information of the headset 400, or information describing the audio content. The audio assembly receives one or more acoustic parameters from the audio server and generates the audio content such that the audio content appears originating from an object in the local area, which is known as spatialized audio content. In some embodiments, the audio assembly includes the speakers 415*a* and 415*b*, an array of acoustic sensors 435, and the audio controller 420.

The speakers 415*a* and 415*b* produce sound for user's ears. The speakers 415*a*, 415*b* are embodiments of transducers of the speaker assembly 215 in FIG. 2B. The speakers 415*a* and 415*b* receive audio instructions from the audio controller 420 to generate sounds. The speaker 415*a* may obtains a left audio channel from the audio controller 420, and the speaker 415*b* obtains and a right audio channel from the audio controller 420. As illustrated in FIG. 4, each speaker 415*a*, 415*b* is coupled to an end piece of the frame 405 and is placed in front of an entrance to the corresponding ear of the user. Although the speakers 415*a* and 415*b* are shown exterior to the frame 405, the speakers 415*a* and 415*b* may be enclosed in the frame 405. In some embodiments, instead of individual speakers 415*a* and 415*b* for each ear, the headset 110 includes a speaker array (not shown in FIG. 4) integrated into, e.g., end pieces of the frame 405 to improve directionality of presented audio content.

The array of acoustic sensors 435 monitors and records sound in a local area surrounding some or all of the headset 110. The array of acoustic sensors 435 is an embodiment of the microphone assembly 225 of FIG. 3B. As illustrated in FIG. 4, the array of acoustic sensors 435 include multiple acoustic sensors with multiple acoustic detection locations that are positioned on the headset 110.

The audio controller 420 provides audio instructions to the speakers 415*a*, 415*b* for generating sound by generating audio content using one or more acoustic parameters (e.g., a reverberation time). The audio controller 420 is an embodiment of the audio controller 235 of FIG. 3B. The audio controller 420 presents the audio content to appear originating from an object (e.g., virtual object or real object) within the local area, e.g., by transforming a source audio signal using the acoustic parameters for a current configuration of the local area.

The audio controller 420 may obtain visual information describing at least a portion of the local area, e.g., from the DCA 425 and/or the PCA 430. The visual information obtained at the audio controller 420 may include depth image data captured by the DCA 425. The visual information obtained at the audio controller 420 may further include color image data captured by the PCA 430. The audio controller 420 may combine the depth image data with the color image data into the visual information that is communicated (e.g., via a communication module coupled to the audio controller 420, not shown in FIG. 4) to the audio server 130 for determination of material acoustic parameters. In one embodiment, the communication module (e.g., a transceiver) may be integrated into the audio controller 420. In another embodiment, the communication module may be external to the audio controller 420 and integrated into the frame 405 as a separate module coupled to the audio controller 420, e.g., the communication module 245 of FIG. 2B. In some embodiments, the audio controller 420 runs a real-time acoustic ray tracing simulation to measure reverberation times. The communication module coupled to the audio controller 420 may selectively communicate the measured reverberation times to the audio server 130 for determining material acoustic parameters and acoustic parameters of physical spaces at the audio server 130.

Figure 5:
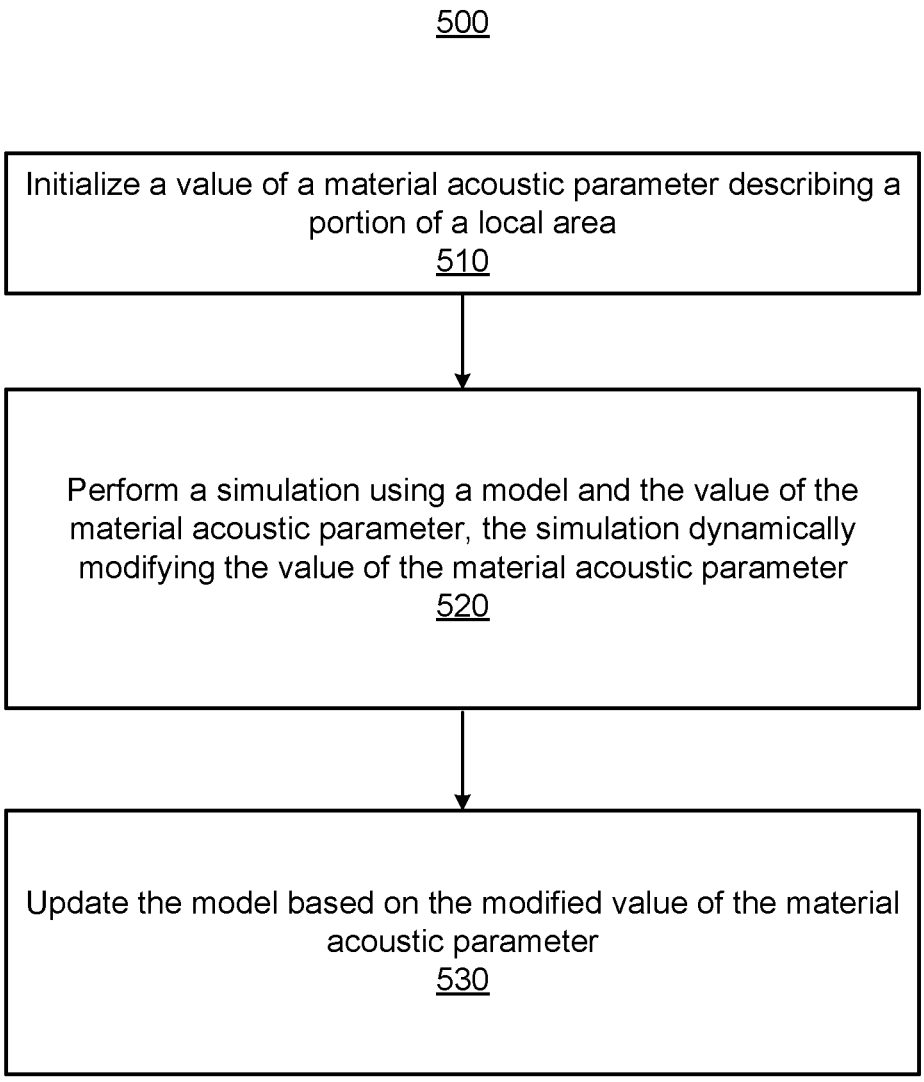
FIG. 5 is a flowchart illustrating a process for determining one or more material acoustic parameters that facilitate presentation of audio content, in accordance with one or more embodiments.

FIG. 5 is a flowchart illustrating a process 500 for determining one or more material acoustic parameters that facilitate presentation of audio content, in accordance with one or more embodiments. The process 500 of FIG. 5 may be performed by the components of an apparatus, e.g., the audio server 130 of FIG. 2A. Other entities (e.g., components of the headset 110 of FIG. 4 and/or components shown in FIG. 6) may perform some or all of the steps of the process in other embodiments. Likewise, embodiments may include different and/or additional steps, or perform the steps in different orders.

The audio server 130 initializes 510 a value of each of one or more material acoustic parameters describing a portion of a local area. The portion of the local area can include surfaces therein, such as walls, surfaces of furniture, surfaces of devices, etc. A material acoustic parameter describes an acoustic property of materials of the surfaces. The material acoustic parameter can be acoustic absorption coefficient, acoustic scattering coefficient, or a combination thereof. In some embodiments, the audio server 130 initializes 510 a value of a material acoustic parameter in response to an acoustic parameter query from an audio assembly implemented on a headset 110. The acoustic parameter query includes at least one of the following: virtual information of the local area, location information of the headset, audio data (e.g., reverberation time) measured by the audio assembly, and location information of a sound source.

For each material acoustic parameter, the audio server 130 performs 520 a simulation using a model and the value of the material acoustic parameter. The model includes a 3D virtual representation describing the surfaces within at least the portion of the local area. The audio server 130 may generate the model based on visual information (e.g., depth information and color image data) of the local area. The simulation dynamically modifies the value of the material acoustic parameter until a simulated reverberation time calculated using the modified value of the material acoustic parameter is within a threshold value of a target reverberation time. The threshold value of a target reverberation time can be 95% or 105% of the target reverberation time. The target reverberation time can be determined based on one or more reverberation times in the acoustic parameter query. In some embodiments, the audio server 130 performs the simulation for each surface of the local area described in the model.

The audio server 130 updates 530 the model based on the modified value of the material acoustic parameter. The modified value of the material acoustic parameter causes the simulated reverberation time to be within the threshold value of the target reverberation time. The updated model can be used to render audio content presented by the headset so that the audio content appears originating from an object in the local area. In some embodiments, the audio server 130 uses the updated model to calculate one or more acoustic parameters. The audio server 130 transmits the acoustic parameters to the headset 110, e.g., the audio controller 235 of the headset 110. The headset 110 renders the audio content and presents the rendered audio content to a user. The rendered audio content appears originating from the sound source, as opposed to the headset 110.

System Environment

Figure 6:
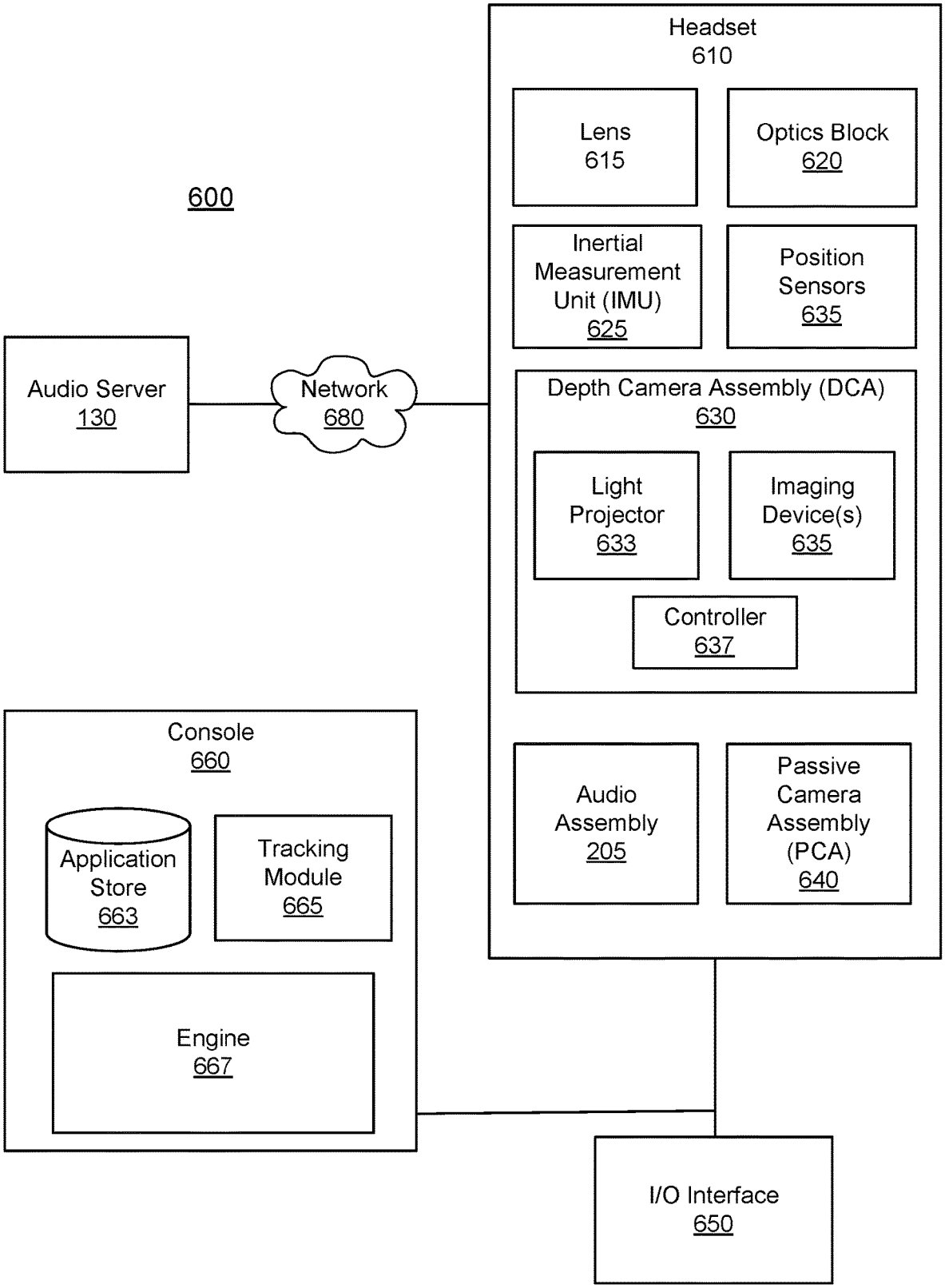
FIG. 6 is a block diagram of a system that includes a headset and an audio server, in accordance with one or more embodiments.

FIG. 6 is a block diagram of a system 600 that includes a headset 610 and an audio server 130, in accordance with one or more embodiments. The system 600 may operate in an artificial reality environment, e.g., a virtual reality, an augmented reality, a mixed reality environment, or some combination thereof. The system 600 shown by FIG. 6 includes the headset 610, the audio server 130, and an input/output (I/O) interface 640 that is coupled to a console 660. The headset 610 communicates with the audio server 130 through network 680. An embodiment of the headset 610 is the headset 110 in FIG. 1 or the headset 400 in FIG. 4. An embodiment of the network 680 is the network 120. While FIG. 6 shows an example system 600 including one headset 610 and one I/O interface 650, in other embodiments any number of these components may be included in the system 600. For example, there may be multiple headsets 110 each having an associated I/O interface 650, with each headset 610 and I/O interface 650 communicating with the console 660. In alternative configurations, different and/or additional components may be included in the system 600. Additionally, functionality described in conjunction with one or more of the components shown in FIG. 6 may be distributed among the components in a different manner than described in conjunction with FIG. 6 in some embodiments. For example, some or all of the functionality of the console 660 may be provided by the headset 610.

The headset 610 includes a display assembly 615, an optics block 620, one or more position sensors 635, the DCA 630, an inertial measurement unit (IMU) 625, the PCA 640, and the audio assembly 205. Some embodiments of headset 610 have different components than those described in conjunction with FIG. 6. Additionally, the functionality provided by various components described in conjunction with FIG. 6 may be differently distributed among the components of the headset 610 in other embodiments, or be captured in separate assemblies remote from the headset 610.

The display assembly 615 includes one or more lenses. The display assembly 615 may include an electronic display that displays 2D or 3D images to the user in accordance with data received from the console 660. In various embodiments, the display assembly 615 comprises a single electronic display or multiple electronic displays (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof.

The optics block 620 magnifies image light received from the electronic display, corrects optical errors associated with the image light, and presents the corrected image light to a user of the headset 610. In various embodiments, the optics block 620 includes one or more optical elements. Example optical elements included in the optics block 620 include: an aperture, a Fresnel lens, a convex lens, a concave lens, a filter, a reflecting surface, or any other suitable optical element that affects image light. Moreover, the optics block 620 may include combinations of different optical elements. In some embodiments, one or more of the optical elements in the optics block 620 may have one or more coatings, such as partially reflective or anti-reflective coatings.

Magnification and focusing of the image light by the optics block 620 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 620 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 620 corrects the distortion after it receives image light from the electronic display generated based on the content.

The IMU 625 is an electronic device that generates data indicating a position of the headset 610 based on measurement signals received from one or more of the position sensors 635. A position sensor 440 generates one or more measurement signals in response to motion of the headset 610. Examples of position sensors 635 include: one or more accelerometers, one or more gyroscopes, one or more magnetometers, another suitable type of sensor that detects motion, a type of sensor used for error correction of the IMU 625, or some combination thereof. The position sensors 635 may be located external to the IMU 625, internal to the IMU 625, or some combination thereof.

The DCA 630 generates depth image data of a local area, such as a room. Depth image data includes pixel values defining distance from the imaging device, and thus provides a (e.g., 3D) mapping of locations captured in the depth image data. The DCA 630 in FIG. 6 includes a light projector 633, one or more imaging devices 625, and a controller 630. In some other embodiments, the DCA 630 includes a set of cameras that image in stereo.

The light projector 633 may project a structured light pattern or other light that is reflected off objects in the local area, and captured by the imaging device 635 to generate the depth image data. For example, the light projector 633 may project a plurality of structured light (SL) elements of different types (e.g. lines, grids, or dots) onto a portion of a local area surrounding the headset 610. In various embodiments, the light projector 633 comprises an emitter and a diffractive optical element. The emitter is configured to illuminate the diffractive optical element with light (e.g., infrared light). The illuminated diffractive optical element projects a SL pattern comprising a plurality of SL elements into the local area. For example, each of the SL elements projected by the illuminated diffractive optical element is a dot associated with a particular location on the diffractive optical element.

Each SL element projected by the DCA 630 comprises light in the infrared light part of the electromagnetic spectrum. In some embodiments, the illumination source is a laser configured to illuminate a diffractive optical element with infrared light such that it is invisible to a human. In some embodiments, the illumination source may be pulsed. In some embodiments, the illumination source may be visible and pulsed such that the light is not visible to the eye.

The SL pattern projected into the local area by the DCA 630 deforms as it encounters various surfaces and objects in the local area. The one or more imaging devices 625 are each configured to capture one or more images of the local area. Each of the one or more images captured may include a plurality of SL elements (e.g., dots) projected by the light projector 633 and reflected by the objects in the local area. Each of the one or more imaging devices 625 may be a detector array, a camera, or a video camera.

In some embodiments, the light projector 633 projects light pulses that are reflected off objects in the local area, and captured by the imaging device 635 to generate the depth image data by using time-of-flight techniques. For example, the light projector 633 projects infrared flash for time-of-flight. The imaging device 635 captures the infrared flash reflected by the objects. The controller 637 can use image data from the imaging device 635 to determine distances to the objects. The controller 637 may provide instructions to the imaging device 635 so that the imaging device 635 captures the reflected light pulses in synchronization with the projection of the light pulses by the light projector 633.

The controller 637 generates the depth image data based on light captured by the imaging device 635. The controller 637 may further provide the depth image data to the console 660, the audio controller 420, or some other component.

The PCA 640 includes one or more passive cameras that generate color (e.g., RGB) image data. Unlike the DCA 630 that uses active light emission and reflection, the PCA 640 captures light from the environment of a local area to generate image data. Rather than pixel values defining depth or distance from the imaging device, the pixel values of the image data may define the visible color of objects captured in the imaging data. In some embodiments, the PCA 640 includes a controller that generates the color image data based on light captured by the passive imaging device. In some embodiments, the DCA 630 and the PCA 640 share a common controller. For example, the common controller may map each of the one or more images captured in the visible spectrum (e.g., image data) and in the infrared spectrum (e.g., depth image data) to each other. In one or more embodiments, the common controller is configured to, additionally or alternatively, provide the one or more images of the local area to the audio controller 420 or the console 66060.

The audio assembly 205 presents audio content to a user of the headset 610 using acoustic parameters representing an acoustic property of a local area where the headset 610 is located. In some embodiments, the audio assembly 205 sends an acoustic parameter query to the audio server 130 to request the acoustic parameters. The acoustic parameter query includes virtual information of the local area, location information of the headset, and/or information of the audio content. The audio assembly 205 receives the acoustic parameters from the audio server 130 through the network 680. The audio assembly 205 uses the acoustic parameters to render the audio content to spatialized audio content that when presented, appears originating from an object (e.g., virtual object or real object) within the local area. The audio assembly 205 may obtain information describing at least a portion of the local area. The audio assembly 205 may communicate the information to the audio server 130 for determination of the set of acoustic parameters at the audio server 130. The audio assembly 205 may also receive acoustic parameters (e.g., reverberation time) from the audio server 130.

In some embodiments the audio assembly 205 has some or all of the functionality of the audio server 130. The audio assembly 205 of the headset 610 and the audio server 130 may communicate via a wired or wireless communication link (e.g., the network 680).

The audio server 130 determines material acoustic parameters for the local area based on the acoustic parameter query from the audio assembly 205. The audio server 130 determines a model of the local area using the information in the acoustic parameter query. The model is a 3D virtual representation of at least a portion of the local area and uses one or more material acoustic parameters to describe acoustic properties of surfaces within the local area. The audio server 130 initializes a value of each of one or more material acoustic parameters. The audio server 130 performs a simulation of reverberation time using the model and the value of each material acoustic parameter. The simulation dynamically modifies the value of each material acoustic parameter until a simulated reverberation time calculated using the value of the material acoustic parameter is within a threshold value of a target reverberation time. The audio server 130 updates the model based on the modified value of each material acoustic parameter that causes the simulated reverberation time to be within the threshold value of the target reverberation time. In some embodiments, the audio server 130 performs the simulation for each of a plurality of target reverberation times area and updates the model with a modified value of each material acoustic parameter for each surface within the local area that causes the simulated reverberation time to be within the threshold value of the target reverberation time. The audio server 130 uses the updated model to determine one or more acoustic parameters and sends the acoustic parameters to the audio assembly 205 for rendering audio content.

The I/O interface 650 is a device that allows a user to send action requests and receive responses from the console 660. An action request is a request to perform a particular action. For example, an action request may be an instruction to start or end capture of image or video data, or an instruction to perform a particular action within an application. The I/O interface 650 may include one or more input devices. Example input devices include: a keyboard, a mouse, a game controller, or any other suitable device for receiving action requests and communicating the action requests to the console 660. An action request received by the I/O interface 650 is communicated to the console 660, which performs an action corresponding to the action request. In some embodiments, the I/O interface 650 includes the IMU 625, as further described above, that captures calibration data indicating an estimated position of the I/O interface 650 relative to an initial position of the I/O interface 650. In some embodiments, the I/O interface 650 may provide haptic feedback to the user in accordance with instructions received from the console 660. For example, haptic feedback is provided after an action request is received, or the console 660 communicates instructions to the I/O interface 650 causing the I/O interface 650 to generate haptic feedback after the console 660 performs an action.

The console 660 provides content to the headset 610 for processing in accordance with information received from one or more of: the DCA 425, the PCA 640, the headset 610, and the I/O interface 650. In the example shown in FIG. 6, the console 660 includes an application store 663, a tracking module 665, and an engine 667. Some embodiments of the console 660 have different modules or components than those described in conjunction with FIG. 6. Similarly, the functions further described below may be distributed among components of the console 660 in a different manner than described in conjunction with FIG. 6. In some embodiments, the functionality discussed herein with respect to the console 660 may be implemented in the headset 610, or a remote system.

The application store 663 stores one or more applications for execution by the console 660. An application is a group of instructions, that when executed by a processor, generates content for presentation to the user. Content generated by an application may be in response to inputs received from the user via movement of the headset 610 or the I/O interface 650. Examples of applications include: gaming applications, conferencing applications, video playback applications, or other suitable applications.

The tracking module 665 calibrates the local area of the system 600 using one or more calibration parameters and may adjust one or more calibration parameters to reduce error in determination of the position of the headset 610 or of the I/O interface 650. For example, the tracking module 665 communicates a calibration parameter to the DCA 630 to adjust the focus of the DCA 630 to more accurately determine positions of SL elements captured by the DCA 425. Calibration performed by the tracking module 665 also accounts for information received from the IMU 625 in the headset 610 and/or an IMU 625 included in the I/O interface 650. Additionally, if tracking of the headset 610 is lost (e.g., the DCA 630 loses line of sight of at least a threshold number of the projected SL elements), the tracking module 665 may re-calibrate some or all of the system 600.

The tracking module 665 tracks movements of the headset 610 or of the I/O interface 650 using information from the DCA 425, the PCA 640, the one or more position sensors 635, the IMU 625 or some combination thereof. For example, the tracking module 665 determines a position of a reference point of the headset 610 in a mapping of a local area based on information from the headset 610. The tracking module 665 may also determine positions of an object or virtual object. Additionally, in some embodiments, the tracking module 665 may use portions of data indicating a position of the headset 610 from the IMU 625 as well as representations of the local area from the DCA 630 to predict a future location of the headset 610. The tracking module 665 provides the estimated or predicted future position of the headset 610 or the I/O interface 650 to the engine 667.

The engine 667 executes applications and receives position information, acceleration information, velocity information, predicted future positions, or some combination thereof, of the headset 610 from the tracking module 665. Based on the received information, the engine 667 determines content to provide to the headset 610 for presentation to the user. For example, if the received information indicates that the user has looked to the left, the engine 667 generates content for the headset 610 that mirrors the user's movement in a virtual local area or in a local area augmenting the local area with additional content. Additionally, the engine 667 performs an action within an application executing on the console 660 in response to an action request received from the I/O interface 650 and provides feedback to the user that the action was performed. The provided feedback may be visual or audible feedback via the headset 610 or haptic feedback via the I/O interface 650.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A method comprising:

initializing a value of a first material acoustic parameter of each of a plurality of surfaces in a local area based on a model of the local area;

performing a simulation that calculates a value of a second material acoustic parameter based on the initialized value of the first material acoustic parameter of each of the plurality of surfaces, the simulation modifying the value of the first material acoustic parameter of each of the plurality of surfaces to a modified value of the first material acoustic parameter until a simulated value of the second material acoustic parameter calculated using the modified value of the first material acoustic parameter is within a threshold value of a target value of the second material acoustic parameter, the simulation comprising a sequence of iterations, wherein each iteration in the sequence comprises:

performing an acoustic probe based on a sound source and a sound listener that are coincident at a particular probe location within the local area, detecting the target value of the second material acoustic parameter based on the acoustic probe, and modifying the value of the first material acoustic parameter of a surface of the plurality of surfaces by a predetermined increment based on both the detected target value of the second material acoustic parameter and the calculated value of the second material acoustic parameter; and updating the model based on the modified value of the first material acoustic parameter of each of the plurality of surfaces that causes the simulated value of the second material acoustic parameter to be within the threshold value of the target value of the second material acoustic parameter, wherein the updated model is used to render audio content presented by a headset.

2. The method of claim 1, wherein the first or second material acoustic parameter describes an acoustic property of a material of a surface within the local area.

3. The method of claim 1, wherein the first material acoustic parameter is acoustic absorption coefficient, acoustic scattering coefficient, or a combination thereof.

4. The method of claim 1, wherein the second material acoustic parameter is reverberation time.

5. The method of claim 4, further comprising:

receiving a plurality of reverberation times of the local area from the headset; and determining the target value of the second material acoustic parameter based on the plurality of reverberation times.

6. The method of claim 5, wherein determining the target value of the second material acoustic parameter based on the plurality of reverberation times comprises:

determining a weight of each of the plurality of reverberation times; and determining a weighted average of the plurality of reverberation times.

7. The method of claim 1, further comprising:

developing a 3D virtual representation based on visual information of at least a portion of the local area.

8. The method of claim 7, further comprising:

receiving virtual information of at least the portion of the local area from the headset.

9. The method of claim 1, further comprising:

determining one or more acoustic parameters for the local area by using the updated model; and transmitting the one or more acoustic parameters to the headset, the headset configured to render the audio content based on the one or more acoustic parameters and to present the rendered audio content.

10. The method of claim 1, wherein the local area is a conference room, a bathroom, a hallway, an office, a bedroom, a dining room, a living room, or some combination thereof.

11. An apparatus comprising:

an initializing module configured to initialize a value of a material acoustic parameter describing a local area based on a model that comprises a three-dimensional (3D) virtual representation describing a plurality of surfaces in the local area, wherein the initializing module is configured to initialize the value of the material acoustic parameter by:

assigning a same value of the material acoustic parameter to each of the plurality of surfaces described in the 3D virtual representation, the plurality of surfaces having different materials; and an acoustic simulation module configured to:

perform a simulation that calculates a value of a second material acoustic parameter based on the initialized value of a first material acoustic parameter of each of the plurality of surfaces, the simulation modifying the value of the first material acoustic parameter of each of the plurality of surfaces to a modified value of the first material acoustic parameter until a simulated value of the second material acoustic parameter calculated using the modified value of the first material acoustic parameter is within a threshold value of a target value of the second material acoustic parameter, the simulation comprising a sequence of iterations, wherein each iteration in the sequence is configured to:

perform an acoustic probe based on a sound source and a sound listener that are coincident at a particular probe location within the local area, detect the target value of the second material acoustic parameter based on the acoustic probe, and modify the value of the first material acoustic parameter of a surface of the plurality of surfaces by a predetermined increment based on both the detected target value of the second material acoustic parameter and the calculated value of the second material acoustic parameter, and update the model based on the modified value of the material acoustic parameter of each of the plurality of surfaces that causes a simulated reverberation time to be within the threshold value of the target value of the second material acoustic parameter, wherein the updated model is used to render audio content presented by a headset.

12. The apparatus of claim 11, wherein the first or second material acoustic parameter describes an acoustic property of a material of a surface within the local area.

13. The apparatus of claim 11, wherein the apparatus is configured to:

develop the 3D virtual representation based on visual information of at least a portion of the local area.

14. The apparatus of claim 13, wherein the apparatus is further configured to:

receive virtual information of at least the portion of the local area from the headset.

15. The apparatus of claim 11, wherein the apparatus is configured to:

determine one or more acoustic parameters for the local area by using the updated model; and transmit the one or more acoustic parameters to the headset, the headset configured to render the audio content based on the one or more acoustic parameters and to present the rendered audio content.

16. A non-transitory computer-readable storage medium having instructions encoded thereon that, when executed by a processor, cause the processor to:

initialize a value of a material acoustic parameter describing a local area based on a model that comprises a three-dimensional (3D) virtual representation describing a plurality of surfaces in the local area, wherein the instructions for initializing the value of the material acoustic parameter comprise instructions, when executed by the processor, cause the processor to:

assign a same value of the material acoustic parameter to each of the plurality of surfaces described in the 3D virtual representation, the plurality of surfaces having different materials;

perform a simulation that calculates a value of a second material acoustic parameter based on the initialized value of a first material acoustic parameter of each of the plurality of surfaces, the simulation modifying the value of the first material acoustic parameter of each of the plurality of surfaces to a modified value of the first material acoustic parameter until a simulated value of the second material acoustic parameter calculated using the modified value of the first material acoustic parameter is within a threshold value of a target value of the second material acoustic parameter, the simulation comprising a sequence of iterations, wherein each iteration in the sequence is configured to:

perform an acoustic probe based on a sound source and a sound listener that are coincident at a particular probe location within the local area, detect the target value of the second material acoustic parameter based on the acoustic probe, and modify the value of the first material acoustic parameter of a surface of the plurality of surfaces by a predetermined increment based on both the detected target value of the second material acoustic parameter and the calculated value of the second material acoustic parameter; and update the model based on the modified value of the material acoustic parameter of each of the plurality of surfaces that causes a simulated reverberation time to be within the threshold value of the target value of the second material acoustic parameter, wherein the updated model is used to render audio content presented by a headset.

17. The computer readable medium of claim 16, wherein the first or second material acoustic parameter describes an acoustic property of a material of a surface within the local area.

18. The computer readable medium of claim 16, wherein the instructions further cause the processor to:

develop the 3D virtual representation based on visual information of at least a portion of the local area.

19. The computer readable medium of claim 18, wherein the instructions further cause the processor to:

receive virtual information of at least the portion of the local area from the headset.

20. The computer readable medium of claim 16, wherein the instructions further cause the processor to:

determine one or more acoustic parameters for the local area by using the updated model; and transmit the one or more acoustic parameters to the headset, the headset configured to render the audio content based on the one or more acoustic parameters and to present the rendered audio content.

* * * * *